United States Patent [19]

Kobayashi et al.

[11] Patent Number: 5,031,369

[45] Date of Patent: Jul. 16, 1991

[54] FREE ACCESS FLOOR

[75] Inventors: Atsuhiko Kobayashi, Kumagaya; Tsutomu Yamaguchi, Yokkaichi, both of Japan

[73] Assignees: Hitachi Metals Ltd., Tokyo; Hitachi Metals Technology, Tokyo, both of Japan

[21] Appl. No.: 561,421

[22] Filed: Aug. 1, 1990

[30] Foreign Application Priority Data

Aug. 2, 1989 [JP] Japan ..... 1-91153[U]

[51] Int. Cl.[5] ..... E04B 5/43; E04B 5/02

[52] U.S. Cl. ..... 52/126.6; 52/263; 52/508

[58] Field of Search ..... 52/126.6, 125.1, 122.1, 52/263, 508, 608

[56] References Cited

U.S. PATENT DOCUMENTS

| | | | |
|---|---|---|---|
| 3,852,928 | 12/1974 | Raith | 52/263 |
| 4,835,924 | 6/1989 | Blacklin et al. | 52/263 |
| 4,914,881 | 4/1990 | Spork | 52/263 |

FOREIGN PATENT DOCUMENTS

| | | | |
|---|---|---|---|
| 3402232 | 8/1985 | Fed. Rep. of Germany | 52/126.6 |
| 46-1936 | 10/1971 | Japan . | |
| 55-87918 | 6/1980 | Japan . | |
| 60-6044 | 1/1985 | Japan . | |
| 62-34044 | 2/1987 | Japan . | |
| 63-42741 | 3/1988 | Japan . | |
| 63-103159 | 5/1988 | Japan . | |
| 773221 | 10/1980 | U.S.S.R. | 52/263 |

*Primary Examiner*—Richard E. Chilcot, Jr.
*Assistant Examiner*—Deborah McGann Ripley
*Attorney, Agent, or Firm*—Sughrue, Mion, Zinn, Macpeak & Seas

[57] ABSTRACT

A free access floor comprising a plurlaity of units juxtaposed to both traversing and vertical direction, each unit comprising two right-angled triangular plates and first, second and third rectangular covers. Two triangular plates are so arranged to constitute a rectangle by facing their hypotenuses to each other. Two other side of each triangular plate have steps. Each triangular plate has three legs at its corners. The first, second and third rectangular covers are rested on the steps of the triangular plates. The triangular plate can be formed as a right-angled isosceles triangle, the first and the second rectangular covers can be formed as identical, and the third rectangular cover can be formed as a square. Each unit can be so arranged that the hypotenuses of the triangular plates of the adjacent unit are mirror symmetrical to each other. All legs gathering to the corners of each third rectangular cover can be grasped by each retainer.

6 Claims, 3 Drawing Sheets

FREE ACCESS FLOOR

BACKGROUND OF THE INVENTION

1. Field of the Invention

This invention relates to a free access floor which is ordinarily used as a floor of an office room, computer room, equipment room, etc. and placed on a floor of the building, in order to lay power cables, communicating cables, pipings, etc. between the free access floor and the floor of the building.

2. Description of the Prior Art

Commonly used free access floor has been comprising a plurality of rectangular or square plates supported by legs at each corner of each plate. This construction has a problem that each plate is apt to shake because of its four point support. Therefore a free access floor formed by a plurality of regular triangular plates has been proposed. This construction has no problem concerning to the shakiness of each plate because of its three point support, but it is impossible to array these triangular plates to fit for a rectangular floor. Moreover it might be easy for wiring or piping in a direction parallel to any side of the triangle, but the legs at the corners of the plates prevent wiring or piping in a direction perpendicular to the side, and it is difficult to support six legs at a corner. Another construction has been proposed in which an access floor is formed by a plurality of pairs of right-angled triangular plates, each pair being faced their hypotenuses to each other so as to constitute a rectangle. This construction needs too many plates.

The object of the present invention is thus to provide an improved free access floor which facilitate wiring or piping in two perpendicular directions under minimum shakiness of the plates. Other objects and advantages of the present invention will become apparent from the detailed description to follow taken in conjunction with the appended claims.

SUMMARY OF THE INVENTION

In accordance with one aspect of the present invention, there is provided a free access floor comprising a plurality of units juxtaposed to both traversing and vertical directions, each unit comprising: two identical right-angled triangular plates, each hypotenuse being faced to each other in such a manner as to constitute a rectangle, two other sides having steps, each triangular plate having three supporting legs at the corners; a first rectangular cover arranged adjacently to one side of said rectangle constituted by the triangular plates and supported by said steps of the triangular plates; a second rectangular cover arranged adjacently to the adjacent side of said rectangle constituted by the triangular plates and supported by said steps of the triangular plates; and a third rectangular cover arranged adjacently to both widths of the first and second rectangular covers and supported by said steps of the triangular plates.

DETAILED DESCRIPTION OF THE INVENTION

Figure 1:
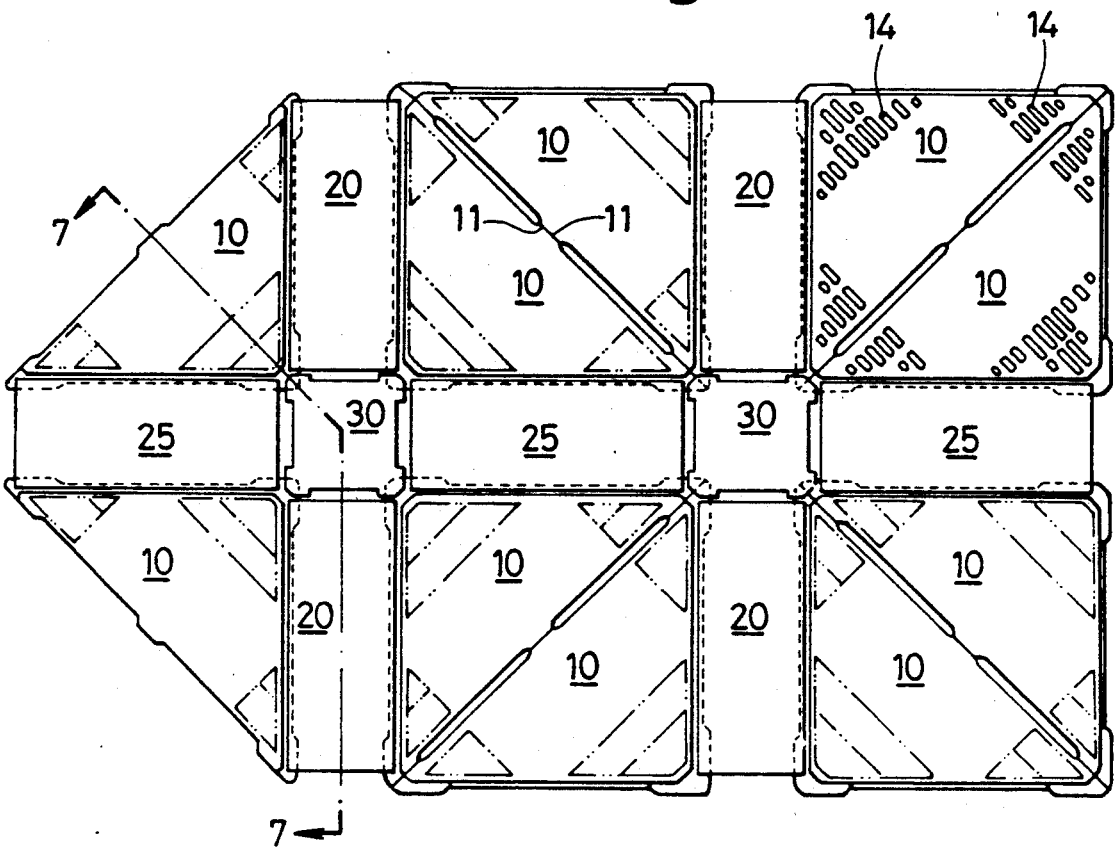
FIG. 1 is a partial plan view of a free access floor of the present invention.

In referring to FIG. 1, the preferred embodiment of the free access floor of the invention is formed by a plurality of units juxtaposed to both traversing and vertical directions, each unit having a pair of right-angled triangular plates 10, 10, a first rectangular cover 20, a second rectangular cover 25, and a third rectangular cover 30.

Figure 2:
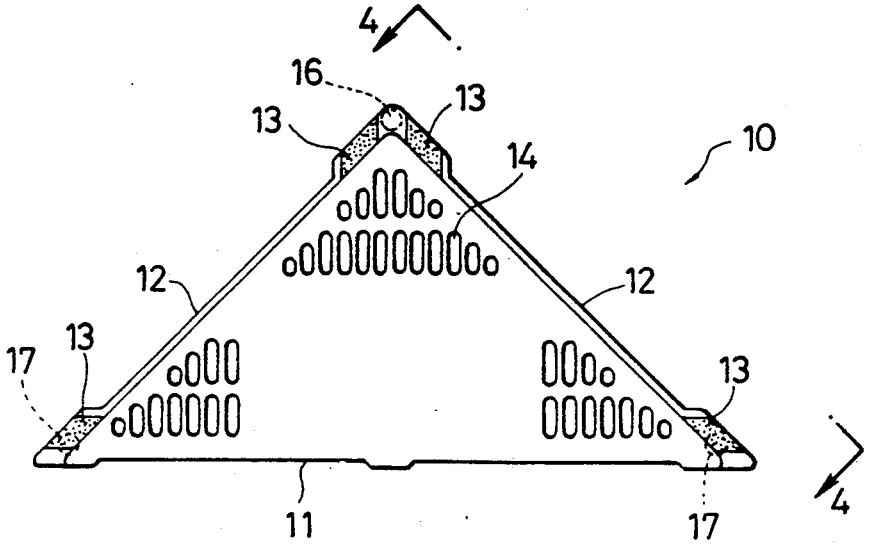
FIG. 2 is a plan view of a triangular plate.
Figure 3:
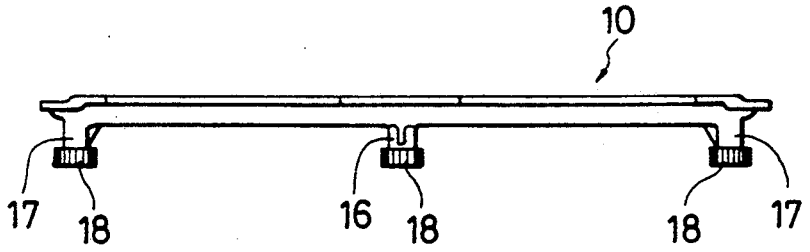
FIG. 3 is a front view of the triangular plate.
Figure 4:
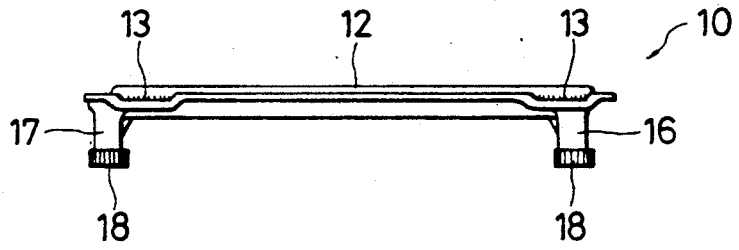
FIG. 4 is a side view of the triangular plate from the direction of 4—4 of FIG. 2.
Figure 7:
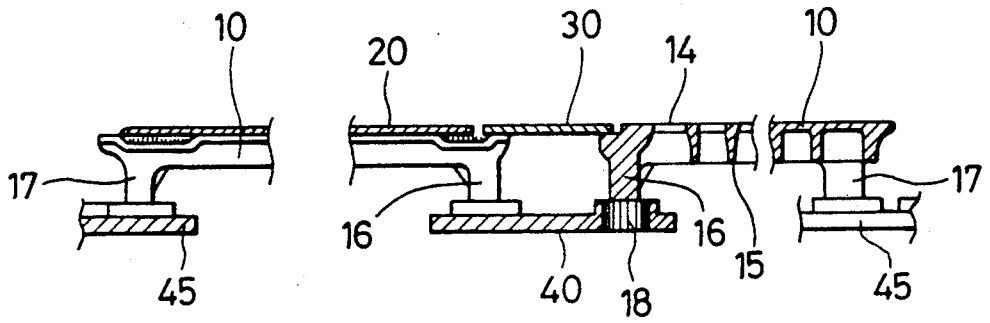
FIG. 7 is a partially cut transverse elevational view taken in the line 7—7 of FIG. 1.

Two right-angled triangular plates 10, 10 are identical in shape and their hypotenuses 11, 11 are faced to each other in such a manner as to constitute a rectangle. Each hypotenuse 11 has convex portions at its center and both ends, where both hypotenuses 11, 11 contacts with each other. Recesses at other locations of the hypotenuse 11 create gaps which allow one to adjust the volume of air blowing through, to check wirings below, and to reduce the weight of the plate. Two shorter sides of the triangular plate 10 have steps 12, 12 as shown in FIG. 2, which are used to support the first, second and third rectangular covers 20, 25, 30 in such a way that the top surfaces of all plates and covers are substantially in a same plane. Each step 12 has concave portions near its both ends in which adhesives 13, 13 are installed to secure the first and second rectangular covers 20, 25 in position. Each triangular plate 10 has many through holes 14 near its three corners to make its weight light and let it easy to check wiring, piping, etc. beneath the plate on the building floor, and has many ribs 15 as shown in FIG. 7 to intensify the construction of the plate 10. Each triangular plate 10 has three legs 16, 17, 17 at its corners as shown in FIGS. 3 and 4, one 16 at the right-angled corner and two others 17, 17 at the acute-angled corners. Each leg has elastic cap 18 which acts as a cushion and noise absorber.

Figure 5:
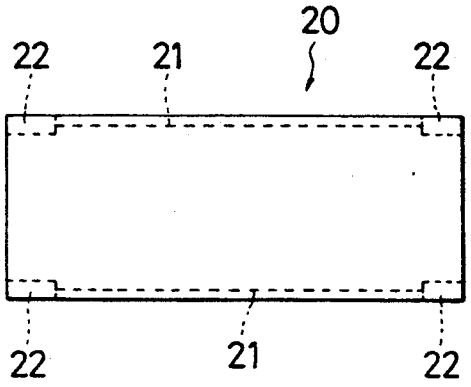
FIG. 5 is a plan view of a first rectangular cover.
Figure 6:
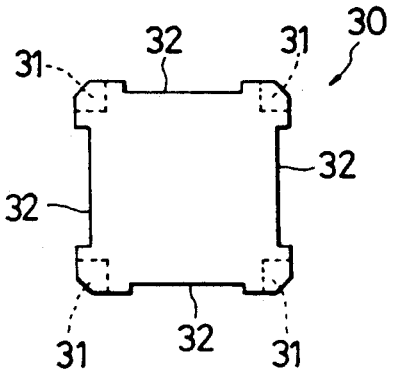
FIG. 6 is a plan view of a third rectangular cover.

The first rectangular cover 20 shown in FIG. 5 has elastic bodies 21, 21 beneath its both sides, each of which rests on the step 12 of the adjacent triangular plate 10 of the unit and on the step 12 of the adjacent triangular plate 10 of the adjacent unit respectively, and act as cushions and absorbers of shakiness and noise. The first rectangular cover 20 has adhesives 22, 22, 22, 22 beneath its four corners which, along with the adhesives 13, 13, 13, 13 of the adjacent triangular plates 10, 10, act to secure itself in position. The second rectangular cover 25 is formed similarly as the first one 20. The third rectangular cover 30 shown in FIG. 6 is arranged adjacently to both widths of the first and the second rectangular plates 20, 25, and has elastic bodies 31, 31, 31, 31 beneath its four corners which rest on the edges of the steps of the adjacent triangular plates. The third rectangular cover 30 has cut-off portions 32, 32, 32, 32 at its four sides in order to remove itself easily. Cut-off portions can otherwise be formed at the widths of the first and/or second rectangular covers 20, 25.

As is easily understood, if the widths of the first and the second rectangular covers 20, 25 are the same, then the third rectangular cover 30 becomes a square. And if moreover each triangular plate 10 is formed as a right-angled isosceles triangle, then the first and the second rectangular covers 20, 25 becomes identical, which case FIG. 1 shows.

Figure 8:
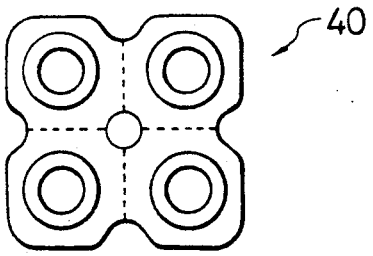
FIG. 8 is a plan view of a retainer for four legs.
Figure 9:
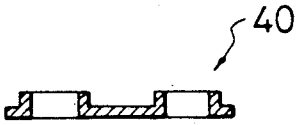
FIG. 9 is a vertical cross section view of the retainer for four legs.
Figure 10:
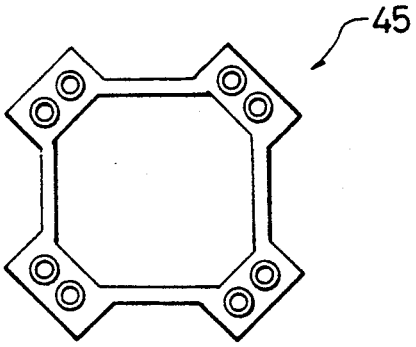
FIG. 10 is a plan view of a retainer for eight legs.

As shown in FIG. 7 all legs of the triangular plates which gather to the corners of a third rectangular cover 30 are grasped by one retainer in order to secure the triangular plates in position. Each retainer comprises a plurality of cylindrical portions and a connecting portion. Bore diameter of the cylindrical portion fit to the outer diameter of the cap 18 of the leg, and the connecting portion secures all of the cylindrical portions of the retainer. If all units, each of which comprises two triangular plates 10, 10 and the first, second and third rectangular covers 20, 25, 30, are set in a same style in both traversing and vertical directions, then each retainer grasps two legs 16, 16 of the right-angled corners of the triangular plates 10, 10 in diagonally and two sets of two legs 17, 17 of the acute-angled corners of the triangular plates 10, 10 in diagonally, that is, six legs in total. In this case each retainer can be formed as identical but is not symmetrical in shape. The similar situation happens if all units are set in a same style in one of the traversing and vertical directions but the hypotenuses 11, 11 of the neighboring units are mirror symmetrical in another direction. FIG. 1 shows the third case in which the hypotenuses 11, 11 of the triangular plates 10, 10 of the neighboring units are mirror symmetrical in both traversing and vertical directions. In this case we need two types of the retainer 40, 45 as shown in FIG. 7. First type of the retainer 40 shown in FIGS. 8 and 9 grasps four legs 16, 16, 16, 16 of the right-angled corners of the triangular plates 10, 10, 10, 10. Second type of the retainer 45 shown in FIG. 10 grasps four sets of the two legs 17, 17 of the acute-angled corners of the triangular plates 10, 10. Both types of the retainer 40, 45 can be formed symmetrical in shape.

On the above-mentioned construction, wiring or piping in both traversing and vertical directions becomes easier by just removing the third rectangular cover 30, and the first and the second rectangular covers 20, 25 if necessary. And as for the two right-angled triangular plates 10, 10 there are no shakiness because of their three point supports.

Although the embodiments of the present invention have been described above, various modifications are possible without departing from the spirit of the invention which is defined solely in the appended claim.

What is claimed is:

1. A free access floor comprising a plurality of units juxtaposed to both traversing and vertical directions, each unit comprising:

two identical right-angled triangular plates, each hypotenuse being faced to each other in such a manner as to constitute a rectangle, two other sides having steps, each triangular plate having three supporting legs at the corners;

a first rectangular cover arranged adjacently to one side of said rectangle constituted by the triangular plates and supported by said steps of the triangular plates;

a second rectangular cover arranged adjacently to another adjacent side of said rectangle constituted by the triangular plates and supported by said steps of the triangular plates; and a third rectangular cover arranged adjacently to both widths of the first and second rectangular covers and supported by said steps of the triangular plates.

2. The free access floor according to claim 1, wherein said right-angled triangular plate is formed as an isosceles triangle, said first and the second rectangular covers are formed identically, and said third rectangular cover is formed as a square.

3. The free access floor according to claim 1, wherein each unit is so arranged that said hypotenuses of the triangular plates of the adjacent unit are mirror symmetrical to each other.

4. The free access floor according to claim 1, wherein all legs gathering to the corners of each third rectangular cover are grasped by each retainer.

5. The free access floor according to claim 1, wherein each step has adhesive to secure said first and second rectangular covers.

6. The free access floor according to claim 1, wherein said third rectangular cover has an cut-off portion in its side.

* * * * *